United States Patent [19]

Kohler

[11] 4,168,663

[45] Sep. 25, 1979

[54] COMPUTER FUZES

[75] Inventor: Hans W. Kohler, Washington, D.C.

[73] Assignee: The United States of America as represented by the Secretary of the Army, Washington, D.C.

[21] Appl. No.: 472,542

[22] Filed: Dec. 1, 1954

[51] Int. Cl.[2] ..... F42C 13/04

[52] U.S. Cl. ..... 102/214; 343/7 PF

[58] Field of Search ..... 343/7 PF; 235/61.5; 102/214

[56] References Cited

U.S. PATENT DOCUMENTS

| | | | |
|---|---|---|---|
| 3,562,752 | 2/1971 | Roeschke | 343/7 PF |
| 3,858,207 | 12/1974 | Macomber et al. | 343/7 PF |
| 3,877,377 | 4/1975 | Rabinow | 343/7 PF X |
| 4,128,836 | 12/1978 | Ramos et al. | 343/7 PF |

*Primary Examiner*—T. H. Tubbesing

*Attorney, Agent, or Firm*—Nathan Edelberg; Robert P. Gibson; Saul Elbaum

EXEMPLARY CLAIM

1. In an ordnance projectile having a side-spray warhead with a static fragmentation velocity $V_{FS}$, an ordnance fuze comprising: radar means for making measurements of range and sight angle of a target; sources of fixed voltages proportional to predetermined target coordinates $Z_1$, $Z_2$, and $Z_3$, in a coordinate system that rides with the fuze, the fuze trajectory being in the plus-Z direction; means for obtaining three voltages proportional to $r_1$, $r_2$, and $r_3$, where $r_1$, $r_2$, and $r_3$ are the fuze-to-target distances when the target Z-coordinates are $Z_1$, $Z_2$, and $Z_3$ respectively; means for obtaining a voltage proportional to $V_Z$, where $V_Z$ is the rate of change of the Z-coordinate of the target with time; a source of fixed voltage proportional to said static fragmentation velocity $V_{FS}$; electronic computer means for solving the equation $$\Delta T = Z_3/V_Z - r_4/V_{FS},$$

where $$r_4 = \sqrt{A^2 r_1^2 - B^2 r_2^2 + C^2 r_3^2},$$

$$A^2 = \frac{Z_2 Z_3}{(Z_1 - Z_3)(Z_1 - Z_2)},$$

$$B^2 = \frac{Z_1 Z_3}{(Z_1 - Z_2)(Z_2 - Z_3)},$$

and $$C^2 = \frac{Z_1 Z_2}{(Z_1 - Z_3)(Z_2 - Z_3)},$$

$r_4$ being the fuze-to-target distance corresponding to Z = zero, said computer means including a subcomputer for solving the equation $$r_4 = \sqrt{A^2 r_1^2 - B^2 r_2^2 + C^2 r_3^2};$$

and means for causing detonation of said warhead at time $t_3 + \Delta T$, where $t_3$ is the time at which the Z-coordinate and distance of the target are $Z_3$ and $r_3$ respectively.

5 Claims, 8 Drawing Figures

Fig. 1.
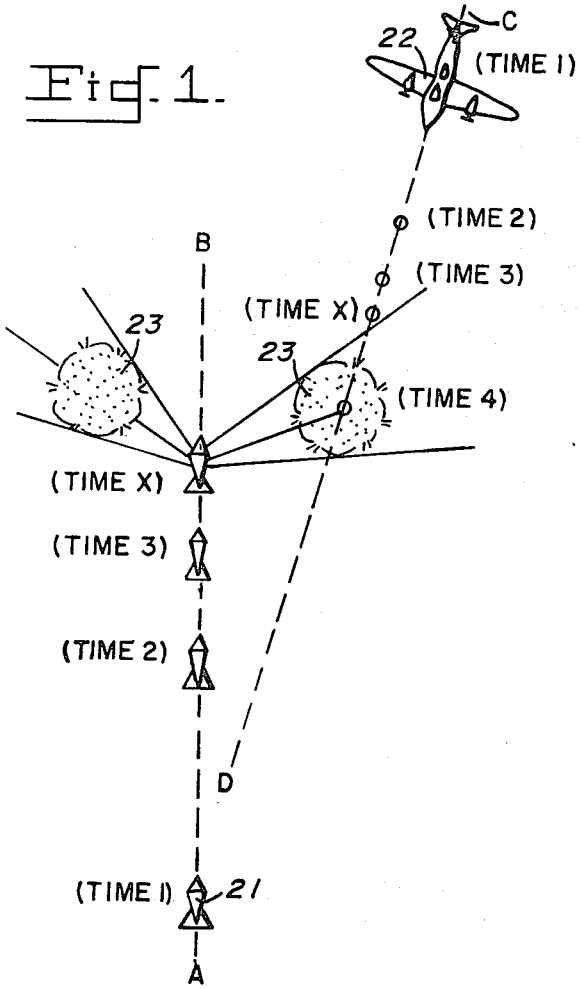
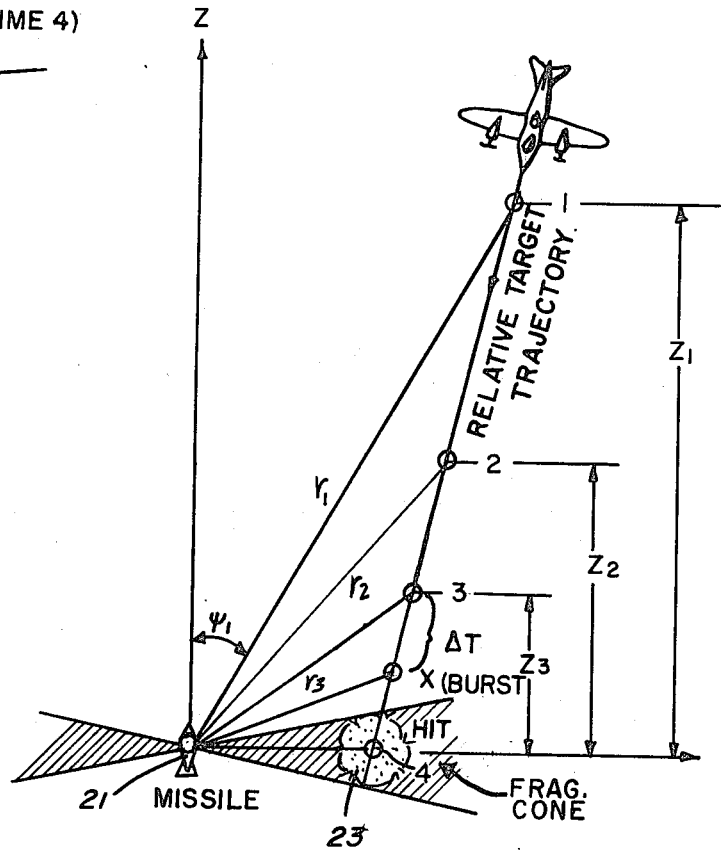
Fig. 2.
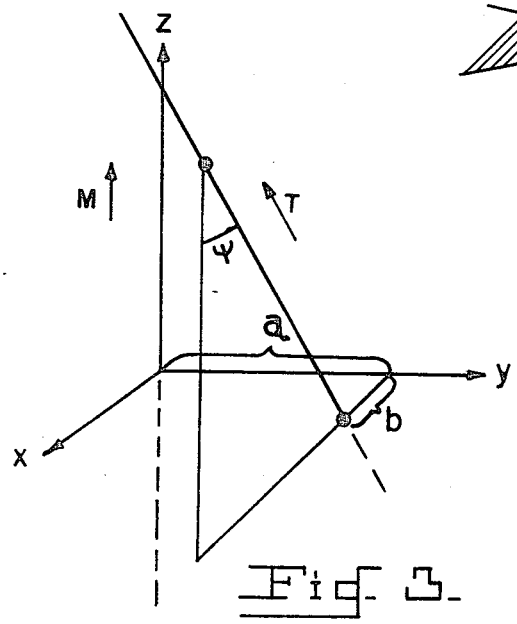
Fig. 3.

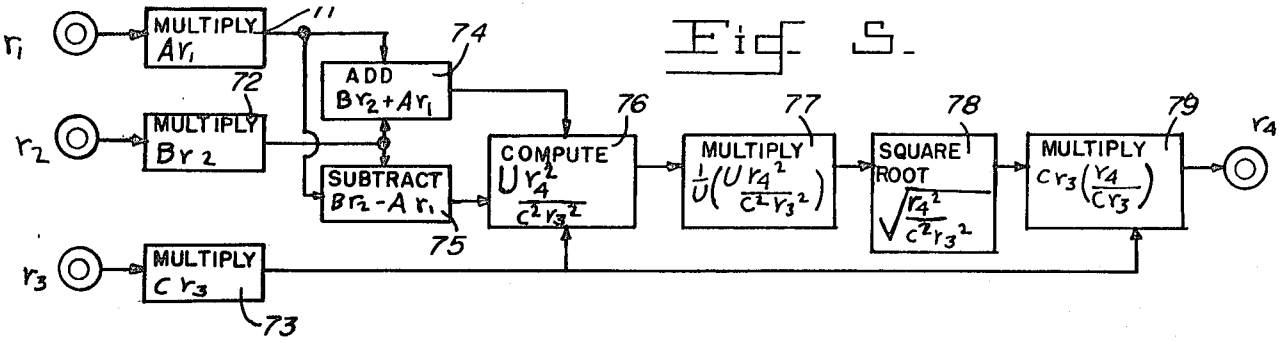
FIG. 5.
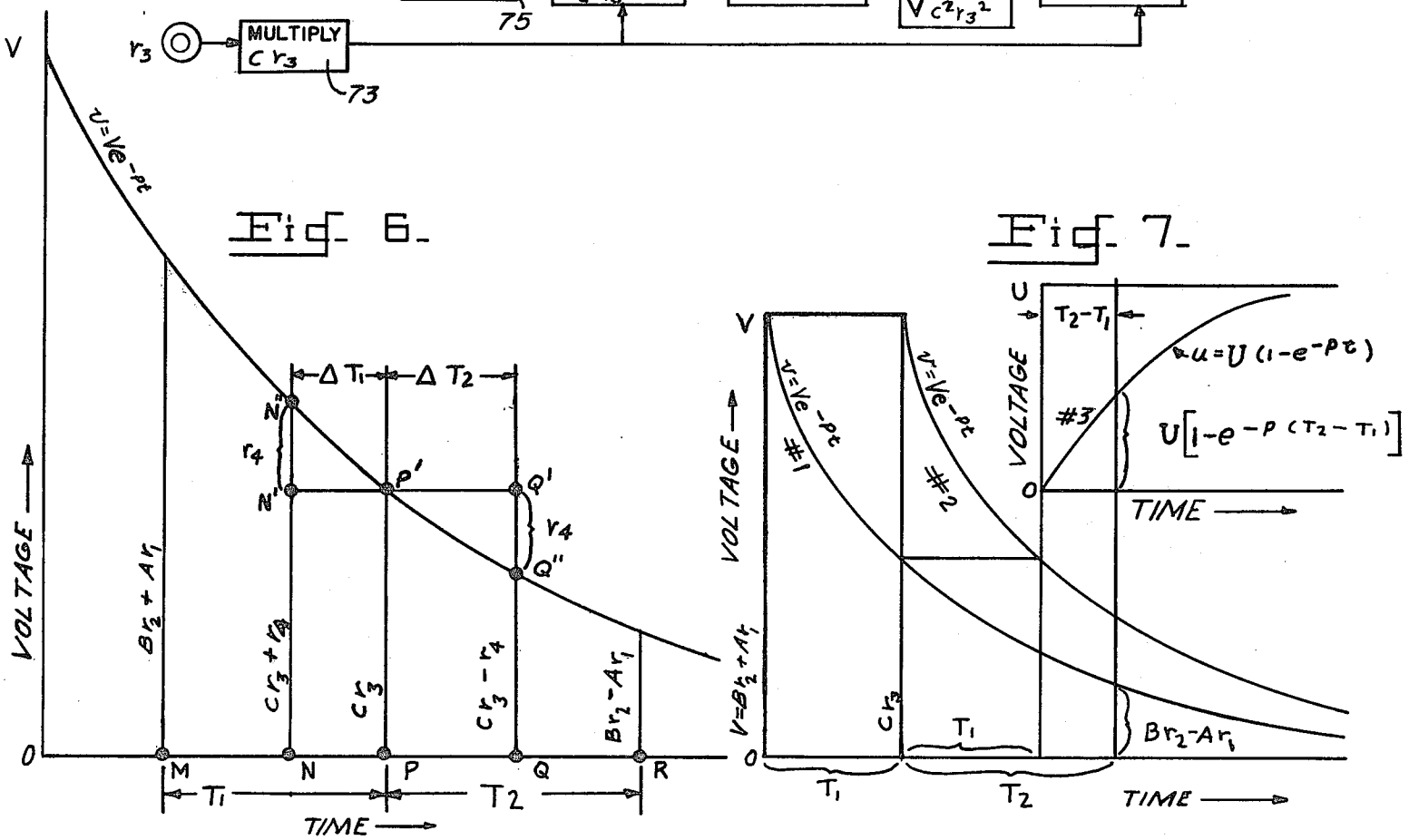
FIG. 6.
FIG. 7.

COMPUTER FUZES

The invention described herein may be manufactured and used by or for the Government for governmental purposes without the payment to me of any royalty thereon.

This invention relates to fuzes for ordnance missiles. The invention provides electronic ordnance fuzes in which data relating to the trajectories and velocities of missile and target are fed to electronic computers; the computers use these data to cause detonation of the missile at the most effective instant. The invention is particularly applicable to guided missiles.

Radio proximity fuzes for ordnance missiles, first used in World War II, have assumed increasingly great importance. In general, radio proximity fuzes transmit their own radio signal and detect the presence of a target by sensing reflection of the transmitted signal when the target comes within range. Because proximity-fuzed missiles do not have to make direct hits to cause damage, their effectiveness against aerial and other targets is much greater than that of other missiles.

The simpler radio-proximity-fuzed missiles have generally omnidirectional burst patterns, and they detonate as soon as a sufficiently strong signal is received from a target. This design does not insure the maximum possible effectiveness of each missile. However, this design is economical and is appropriate for use with non-guided missiles of relatively low cost that are fired in large quantities at aerial targets.

Ground-to-air and air-to-air guided missiles, however, require a somewhat different design philosophy with respect to fuzing and burst pattern. The equipment needed to propel a guided missile and to make it "home" automatically on an aerial target makes a guided missile an inherently expensive device, compared with non-guided-missiles. Guided missiles, then, are weapons to be used sparingly, and it is militarily and economically essential that each individual missile be designed for maximum effectiveness against its intended target.

One valuable step that has been taken to increase the effectiveness of guided missiles has been the use of warheads having a concentrated "side-spray" burst pattern; instead of being omnidirectional, the burst pattern is concentrated with a biconical region of perhaps 20 degrees. Provided the target is in the direction of the burst pattern, the side-spray warhead has a greater effective range than an omnidirectional warhead of the same size, and is more effective against a target at a given distance within this range. However, the side-spray warhead imposes more rigid requirements on the fuzing system, since the fuze must so time the detonation as to place the target within the burst pattern.

For certain encounter paramters, one successful answer to the problem of fuzing side-spray warheads has been the "fixed-angle" fuze. In the side-spray warhead, although the burst pattern is usually concentrated largely at right angles to the axis of the missile, the burst fragments are also given a forward component of motion substantially equal to the missile velocity. Thus in relation to the ground the burst fragments move forward in a conical pattern, the angle of the cone being determined by the resultant of the forward velocity of the missile and the lateral ejection velocity of the fragments. In a typical fixed-angle fuze, the fuze—by proper selection of operating frequency and antenna design—is made to have a forward-looking sensitivity cone that approximately coincides with the fragmentation cone. Unless the target has too large a velocity relative to the missile, this fixed-angle fuze arrangement will in general cause the target to be struck by the burst.

However, if the target has a high velocity relative to the missile, it is likely to escape the burst of a fixed-angle-fuzed missile. For this reason, an enemy missile is likely to be a particularly difficult target for a defensive guided missile.

The principal object of my invention is to provide an improved electronic fuze for ordnance missiles, particularly guided missiles, that will cause detonation of the missile at the optimum time for maximum effectiveness against an aerial target, regardless of the relative trajectory and velocity of the target.

Briefly, I attain this object by means of a fuze that makes a plurality of measurements of fuze-to-target distance, of target angle with respect to the missile axis, and of time intervals between measurement points. These data, in electrical form, are supplied to an electronic computer, which predicts the course of the missile relative to the target, determines the best position for missile detonation, and causes detonation when this position is reached.

Other objects, aspects, uses, and advantages of my invention will become apparent from the following description and from the accompanying drawing, in which:

FIG. 1 is a representation of the trajectories of a missile and a target relative to the ground, showing the position of both missile and target at successive times.

FIG. 2 is a representation of the same encounter as that of FIG. 1, conformed to a coordinate system that rides on the missile; the trajectory of the target is shown relative to the missile.

FIG. 5 is a block diagram of a d-c analog computer for solving the fragment trajectory length equation $r_4=\sqrt{A^2r_1^2-B^2r_2^2+C^2r_3^2}$.

FIG. 6 is a decaying exponential voltage-time curve illustrative of certain steps in the solution of the equation $r_4=\sqrt{A^2r_1^2-B^2r_2^2+C^2r_3^2}$.

FIG. 7 is a group of voltage-time curves illustrative of a method for obtaining a voltage proportional to $[1-e^{-p(T2-T1)}]$, used in the solution of the fragment trajectory length equation.

FIG. 8 is a block diagram of an a-c computer for solving the equation $r_4=\sqrt{A^2r_1^2-B^2r_2^2+C^2r_3^2}$.

Figure 3:
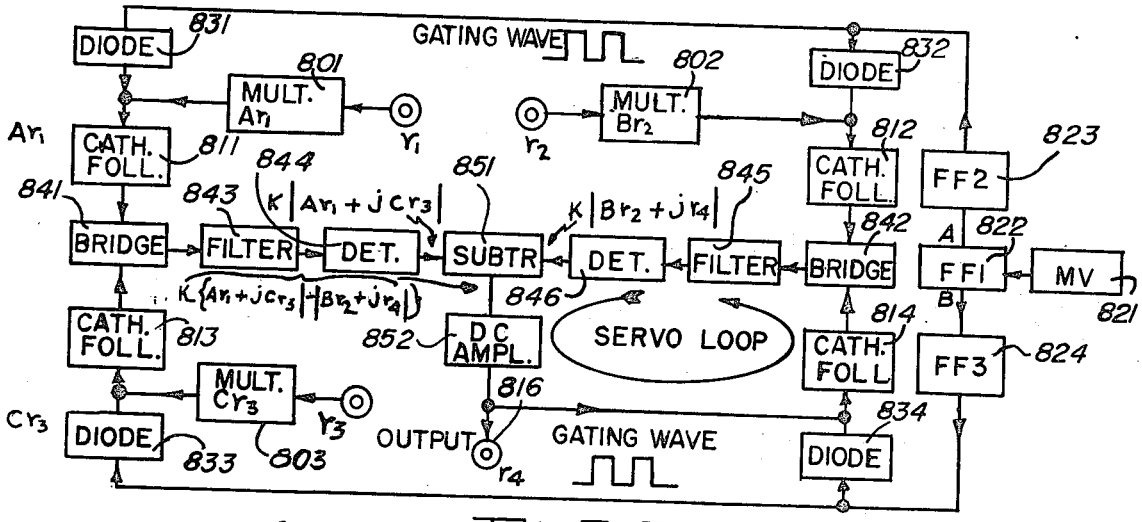
FIG. 3 is a 3-dimensional diagram relating to the derivation of a fragment trajectory length equation.

In FIG. 1, a missile 21 of the side-spray warhead type and a target 22 are shown moving along trajectories AB and CD respectively, at successive times 1, 2, 3, x, and 4. At all times of present interest the trajectories of both missile and target can be considered to be essentially straight lines. However, it will be understood that the encounter is three dimensional, and that the trajectories will not in general intersect.

My invention is concerned with the problem of how to select the time of detonation so that, as the expanding toroid of warhead fragments 23 moves outward with finite velocity it will strike the target 22 at time 4. It will be understood that, although I prefer to use a warhead with the side-spray centered at 90°, the forward motion of the missile will impart to the fragments a component of motion relative to ground.

In FIG. 2, the encounter of FIG. 1 is shown conformed to a system of coordinates that rides on the missile; the missile axis, missile trajectory, and Z axis are collinear, and the missile points in the +Z direction. $\Psi$ is the signt angle of the target (measured from the missile axis) and r is the range (i.e., the missile-to-target distance). The Z coordinate of the target is given by r cos $\Psi$.

I prefer to select in advance the values of Z for three suitable measurement points. Theory and numerical work indicate that it is advantageous to have the first measurement point far out, the third near the point of hit, and the second with approximately twice the ordinate of the third. A practical compromise selection of measurement points is one with the ordinates $Z_1=700$ feet, $Z_2=200$ feet, and $Z_3=100$ feet.

Let $\Delta$ T be the time interval from the third measurement point, whose Z coordinate is $Z_3$, to x, the optimum firing point. It will be understood upon consideration of FIG. 2 that $$\Delta T=Z_3/V_Z-r_4/V_{FS} \tag{1}$$

where $V_Z$ is the relative target velocity component parallel to the rectilinear missile trajectory, $V_{FS}$ is the velocity component of the burst fragments at right angles to the missile trajectory (static fragment velocity), and $r_4$ is the distance from missile trajectory to the point of hit (fragment trajectory length)—i.e., $r_4$ is the range for $\Psi=90°$.

$Z_3$ is pre-selected, $V_{FS}$ is a known constant for any particular design of warhead, and $V_Z$ is readily computed from the elapsed time between two of the three measurement points. The computation of $r_4$ is more difficult, however.

It will be shown below that $$r_4=\sqrt{A^2r_1^2-B^2r_2^2+C^2r_3^2} \tag{2}$$

where $$A^2=\frac{Z_2Z_3}{(Z_1-Z_3)(Z_1-Z_2)} \tag{3}$$

$$B^2=\frac{Z_1Z_3}{(Z_1-Z_2)(Z_2-Z_3)} \tag{4}$$

and $$C^2=\frac{Z_1Z_2}{(Z_1-Z_3)(Z_2-Z_3)} \tag{5}$$

The derivation of equation (2) is as follows:

Referring to FIG. 3, which will be readily understood, the positions of the missile M and the target T at any particular time t will be $$M\begin{cases} x=0 & =x_M \\ y=0 & =y_M \\ Z=V_Mt & =Z_M \end{cases}$$

-continued $$T\begin{cases} x=V_Tt\sin\psi+b & =x_T \\ y=a & =y_T \\ Z=V_Tt\cos\psi & =Z_T, \end{cases}$$

where $V_M$ and $V_T$ are the respective velocities of missile and target. Let r be the missile-to-target distance.

$$r=\sqrt{x_T^2+y_T^2+(Z_T-Z_M)^2} \tag{6}$$

$$r^2=V_T^2t\sin^2\Psi+b^2+2bV_T\sin\Psi+a^2+V_T^2t^2\cos^2\Psi+V_M^2t^2-2V_MV_Tt^2\cos\Psi \tag{7}$$

$$=t^2(V_T^2+V_M^2-2V_MV_T\cos\Psi)+2tbV_T\sin\Psi+a^2+b^2 \tag{8}$$

$$=V_c^2t^2+2tbV_T\sin\Psi+a^2+b^2 \tag{9}$$

where $$V_c^2=V_T^2+V_M^2-2V_MV_T\cos\Psi$$

$$=\alpha^2Z^2+\beta Z+\gamma \tag{10}$$

where $$\alpha^2=V_c^2/k^2$$

$$Z=kt$$

$$\beta=2bV_T\sin\Psi$$

$$\gamma=a^2+b^2$$

For a particular encounter, $\alpha$, $\beta$, and $\gamma$ are all constants. At three different times during the encounter, $$r_1^2=\alpha^2Z_1^2+\beta Z_1+\gamma \tag{11}$$

$$r_2^2=\alpha^2Z_2^2+\beta Z_2+\gamma \tag{12}$$

$$r_3^2=\alpha^2Z_3^2+\beta Z_3+\gamma \tag{13}$$

and $$r_1^2-r_2^2=\alpha^2(Z_1^2-Z_2^2)+\beta(Z_1-Z_2) \tag{14}$$

$$r_2^2-r_3^2=\alpha^2(Z_2^2-Z_3^2)+\beta(Z_2-Z_3) \tag{15}$$

$$\frac{r_1^2-r_2^2}{Z_1-Z_2}=\alpha^2(Z_1+Z_2)+\beta \tag{16}$$

$$\frac{r_2^2-r_3^2}{Z_2-Z_3}=\alpha^2(Z_2+Z_3)+\beta \tag{17}$$

$$\frac{r_1^2-r_2^2}{Z_1-Z_2}-\frac{r_2^2-r_3^2}{Z_2-Z_3}=\alpha^2(Z_1-Z_3) \tag{18}$$

$$\frac{r_1^2-r_2^2}{(Z_1-Z_2)(Z_1-Z_3)}-\frac{r_2^2-r_3^2}{(Z_2-Z_3)(Z_1-Z_3)}=\alpha^2 \tag{19}$$

Defining $r_4$ as the range when $Z=Z_4=0$, $$\frac{r_3^2-r_4^2}{Z_3}=\alpha^2Z_3+\beta \tag{20}$$

$$\frac{r_2^2-r_3^2}{Z_2-Z_3}=\alpha^2(Z_2+Z_3)+\beta \tag{17}$$

$$\frac{r_2^2-r_3^2}{Z_2-Z_3}-\frac{r_3^2-r_4^2}{Z_3}=\alpha^2Z_2 \tag{21}$$

$$\frac{r_2^2-r_3^2}{Z_2(Z_2-Z_3)}-\frac{r_3^2-r_4^2}{Z_2Z_3}=\alpha^2 \tag{22}$$

-continued $$= \frac{r_1^2 - r_2^2}{(Z_1 - Z_2)(Z_1 - Z_3)} - \frac{r_2^2 - r_3^2}{(Z_2 - Z_3)(Z_1 - Z_3)} \tag{19}$$

$$r_1^2\left[\frac{1}{(Z_1 - Z_2)(Z_1 - Z_3)}\right] - r_2^2\left[\frac{1}{(Z_1 - Z_2)(Z_1 - Z_3)} + \frac{1}{(Z_2 - Z_3)(Z_1 - Z_3)} + \frac{1}{Z_2(Z_2 - Z_3)}\right]$$

$$+ r_3^2\left[\frac{1}{(Z_2 - Z_3)(Z_1 - Z_3)} + \frac{1}{Z_2(Z_2 - Z_3)} + \frac{1}{Z_2Z_3}\right] = r_4^2\left[\frac{1}{Z_2Z_3}\right] \tag{23}$$

$$r_4 = \sqrt{A^2r_1^2 - B^2r_2^2 + C^2r_3^2} \tag{2}$$

where $$A^2 = \frac{Z_2 \quad Z_3}{(Z_1 - Z_3)(Z_1 - Z_2)} \tag{3}$$

$$B^2 = \frac{Z_1 \quad Z_3}{(Z_1 - Z_2)(Z_2 - Z_3)} \tag{4}$$

$$C^2 = \frac{Z_1 \quad Z_2}{(Z_1 - Z_3)(Z_2 - Z_3)} \tag{5}$$

Q.E.D.

Figure 4:
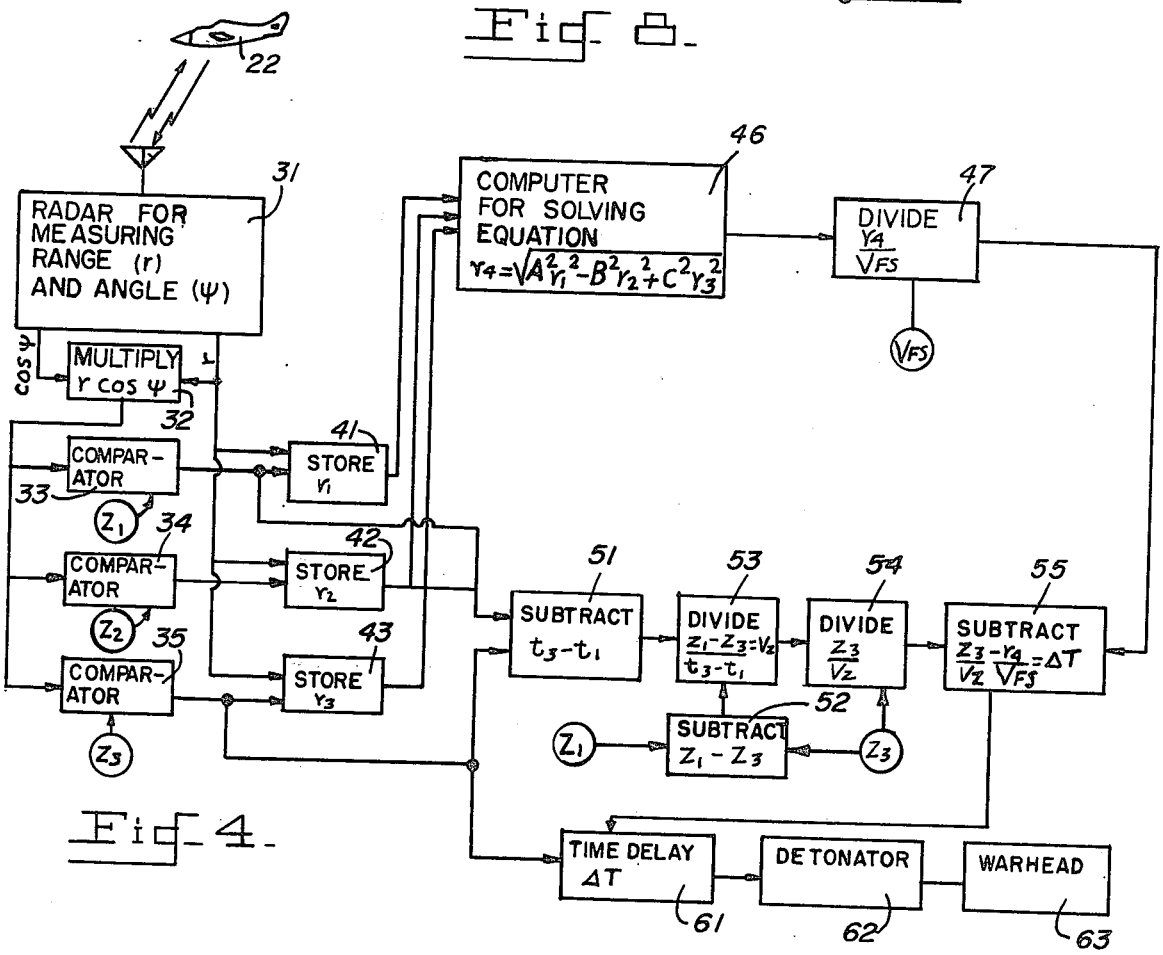
FIG. 4 is a block diagram of a computer fuze in accordance with my invention.

In FIG. 4, the computer fuze shown is adapted to measure the target range for three preselected values of Z, to solve the equation $$\Delta T = Z_3/V_Z - r_4/V_{FS}, \tag{1}$$

and to cause firing of a spray warhead at the optimum time interval $\Delta T$ after the third measurement point.

In FIG. 4, radar 31 is a missile-borne radar set adapted to make quasicontinuous measurements of range r and sight angle $\Psi$ of an aerial target 22 and to give output voltages proportional to r and to cos $\Psi$. Multiplier 32 multiplies these two output voltages from radar 31 to give an output voltage $Z = r \cos \Psi$. The output of multiplier 32 is connected to comparators 33, 34, and 35. Fixed d-c voltages corresponding to preselected ranges $Z_1$, $Z_2$, and $Z_3$ are also connected to comparators 33, 34, and 35 respectively. The "r" voltage output of radar 31 is connected to storage devices 41, 42, and 43. The outputs of comparators 33, 34, and 35 are also connected to storage devices 41, 42, and 43.

When the Z-coordinate of the target reaches the preselected value $Z_1$, comparator 33 gives an output pulse that causes a range voltage $r_1$ to be stored in storage device 41. As the target passes through the preselected $Z_2$ and $Z_3$ planes, range voltages $r_2$ and $r_3$ are similarly stored in storage devices 42 and 43 respectively.

The voltages stored in devices 41, 42, and 43 are operated on by computer 46 which gives an output voltage $r_4$ in accordance with equation (2). Divider 47 divides the output of computer 46 by $V_{FS}$ as above defined, to give a voltage $r_4/V_{FS}$. The outputs of comparators 33 and 35 are connected to subtractor 51; subtractor 51 gives an output voltage proportional to the time interval between time $t_1$ ($Z_1$, $r_1$) at which comparator 33 develops an output signal and time $t_3$ ($Z_3$, $r_3$) at which comparator 35 develops an output signal. Subtractor 52 operates on aforementioned preselected fixed voltages $Z_1$ and $Z_3$ to give an output voltage $(Z_1 - Z_3)$. The outputs of subtractor 51 and subtractor 52 are operated on by divider 53 which gives an output voltage $V_Z = (Z_1 - Z_3)/(t_3 - t_1)$. Divider 54 operates on the output voltage of divider 53 and on the aforementioned preselected fixed voltage $Z_3$ to give an output voltage $Z_3/V_Z$. Subtractor 55 operates on the output voltages of divider 47 and divider 54 to give an output voltage $\Delta T = Z_3/V_2 - r_4/V_{FS}$. The outputs of comparator 35 and of subtractor 55 are applied to time delay device 61, which produces an output pulse at time $\Delta T$ after the time $t_3$ ($Z_3$, $r_3$) at which comparator 35 gives an output signal. The output of time delay device 61 is connected to detonator 62, which causes detonation of warhead 63.

From the foregoing description, persons skilled in the radar and computer arts will be enabled to practice my invention as shown in FIG. 4. It will be understood that computer 46 can be readily constructed to perform sequentially the operations of multiplying, squaring, adding, subtracting, and taking the square root, in accordance with known analogue computer techniques. However, it will also be understood that, because $r_4^2$ is obtained by subtraction of larger quantities, accurate computation of $r_4$ requires high accuracy of primary data and of computation. Furthermore, the computation of $\Delta T$ must be completed by time $\Delta T$ after $t_3$, and $\Delta T$ may be of the order of 10 milliseconds or less in a typical encounter. I will now describe two unobvious forms of computer 46 that are characterized by speed and accuracy.

D-C ANALOG COMPUTER

FIG. 5 is a block diagram of a d-c analog computer suitable for use as computer 46 of FIG. 4. The computer shown in FIG. 5 operates on input voltages $r_1$, $r_2$, and $r_3$ to obtain the output voltage $r_4 = \sqrt{A^2r_1^2 - B^2r_2^2 + C^2r_3^2}$ (equation 2). The three input voltages are first multiplied by respective constants A, B, and C (as defined by equations 3, 4, and 5) in multipliers 71, 72, and 73 to obtain voltages $Ar_1$, $Br_2$, and $Cr_3$. Voltages $Ar_1$ and $Br_2$ are fed to adder 74 which gives an output voltage $Br_2 + Ar_1$ and also to subtractor 75 which gives an output voltage $Br_2 - Ar_1$. Computer 76, which will be described more fully below, operates on the output voltages of adder 74, subtractor 75, and multiplier 73 to give a voltage U $r_4^2/C^2r_3^2$, U being constant for any particular embodiment of computer 76. Multiplier 77 multiplies the output of computer 76 by a constant 1/U to give an output $r_4^2/C^2r_3^2$. Square root circuit 78 operates on the output of multiplier 77 to give an output voltage $r_4/Cr_3$. Multiplier 79 operates on the voltage outputs of square root circuit 78 and multiplier 73 to give the desired output voltage $r_4$.

The operation of computer 76 will be understood in the light of the following explanation.

It will be understood that equation (2) may be rearranged as follows:

$$\frac{Br_2 + Ar_1}{Cr_3 + r_4} = \frac{Cr_3 - r_4}{Br_2 - Ar_1} \quad (24)$$

It will also be understood that the numerator and denominator on each side of equation (24) can be represented as instantaneous voltages of an exponentially decaying voltage-time function.

FIG. 6 shows a decaying exponential voltage-time curve of the form $v=Ve^{-pt}$, which corresponds to a resistor-capacitor combination having a time constant $RC=1/p$. The numerator and denominator of each side of equation (24) are shown as voltages corresponding to various points on the curve. It will be apparent that these four voltages, when known, will define $r_4$.

For equation (24) to hold, the timing must be such that

MN=QR, or

MQ=NR

Points N and Q are not known. A method could be devised for locating points N'' and Q'' by repeated trials, until the conditions MN=QR and $N'N''=Q'Q''=r_4$ are fulfilled. However, I have found a better and faster method of finding $r_4$. The following reasoning leads to my solution.

If $r_4=0$ (direct hit), it will be understood that, if equation (24) is to hold, MP must equal PR; i.e., $T_1=T_2$. Conversely, if $r_4>0$, the inequality of $T_1$ and $T_2$ must be a function of $r_4$. We may write $$\frac{Br_2 + Ar_1}{Cr_3 + r_4} = e^{p(T_1-\Delta T_1)} = \frac{Cr_3 - r_4}{Br_2 - Ar_1} = e^{p(T_2-\Delta T_2)}$$

Thus $$T_2-T_1=\Delta T_2-\Delta T_1>0, \text{ and } T_2 \geqq T_1$$

Also, from FIG. 6, $$\frac{Cr_3 + r_4}{Cr_3} = e^{p\,\Delta T_1}, \text{ and.} \quad (25)$$

$$\frac{Cr_3 - r_4}{Cr_3} = e^{-p\,\Delta T_2} \quad (26)$$

Multiplying equation (25) by equation (26) gives $$\frac{C^2r_3^2 - r_4^2}{C^2r_3^2} = e^{-p(\Delta T_2 - \Delta T_1)} = e^{-p(T_2 - T_1)} \quad (27)$$

Solving equation (27) for $r_4$, we obtain $$r_4=Cr_3\sqrt{1-e^{-p(T_2-T_1)}} \quad (28)$$

FIG. 7 shows how $T_2-T_1$, and a voltage proportional to $[1-e^{-p(T_2-T_1)}]$ can be obtained. Two identical RC circuits are initially charged to a voltage $V=Br_2+Ar_1$. At time t=0 the first circuit (#1) starts its discharge. When circuit #1 reaches level $Cr_3$ it causes the second circuit (#2) to start discharging. When circuit #2 reaches level $Cr_3$, it gates a third RC circuit (#3) having time constant 1/p. Circuit #3 relaxes toward a fixed potential U which may, for example, be 200 volts above ground. When circuit #1 reaches level $[Br_2-Ar_1]$ it closes the gate of circuit #3. The gate was open for a time $[T_1-T_2]$ and allowed circuit #3 to reach the value $U[1-e^{-p(T_2-T_1)}]$.

A-C COMPUTER FOR SOLVING FRAGMENT TRAJECTORY LENGTH EQUATION

An a-c version of computer 46 (FIG. 4) for solving the fragment trajectory length equation (equation 2) will now be described. Again, the problem is to operate on three d-c input voltages—$r_1$, $r_2$, and $r_3$—in such a way as to obtain an output voltage $r_4$ that satisfies equation 3.

It will be understood that equation 2 is equivalent to $$|Ar_1+j\,Cr_3|=|Br_2+j\,r_4| \quad (29)$$

My a-c method of solving this equation involves chopping the input voltages with square waves in phase quadrature and using a voltage-difference error signal and a servo loop to maintain the potential of an output terminal at the value $r_4$ that will satisfy equation (29).

Referring to FIG. 8, input voltages $r_1$, $r_2$, and $r_3$ are multiplied by constants A, B, and C respectively in multipliers 801, 802, and 803 respectively. The outputs of these three multipliers are connected to the grids of cathode followers 811, 812, and 813 respectively. An output terminal 816, from which output voltage $r_4$ is taken, is connected to the grid of cathode follower 814. A free-running multivibrator 821 generates positive pulses at a rate of, for example, 200 kc/sec. The output of multivibrator 821 drives a flip-flop circuit 822. The outputs of the two plates A and B of flip-flop circuit 822 are square waves in push-pull with a fundamental frequency, for the assumed multivibrator frequency, of 100 kc/sec. The positive spikes from plate A of circuit 822 drive a second flip-flop circuit 823, and those from plate B drive a third flip-flop circuit 824. It will be understood that the outputs of flip-flop circuits 823 and 824 are square waves of 50 kc/sec fundamental frequency in phase quadrature. These two 50-kc square waves are used as gating waves: the output of flip-flop 823 is applied to the grids of cathode followers 811 and 812 through coupling diodes 831 and 832 respectively, while the output of flip-flop 824 is applied to the grids of cathode followers 813 and 814 through coupling diodes 833 and 834 respectively.

The outputs of cathode followers 811 and 813, which are in phase quadrature and of amplitudes proportional to $Ar_1$ and $Cr_3$ respectively, are added by means of a bridge circuit 841. Similarly, the outputs of cathode followers 812 and 814 are added by means of bridge circuit 842. The output of bridge 841 is filtered by filter 843 to obtain the fundamental frequency, which is then rectified by detector 844 to obtain a d-c voltage proportional to $|Ar_1+j\,Cr_3|$. Similarly, the output of bridge 842 is filtered by filter 845 to obtain the fundamental frequency, which is then rectified by detector 846 to obtain a d-c voltage proportional to $|Br_2+j\,r_4|$. By making bridges 841 and 842, filters 843 and 845, and detectors 844 and 846 identical, the proportionality constant k for the outputs of detectors 844 and 846 can be made identical.

The d-c voltage outputs of detectors 844 and 846 are subtracted by subtractor 851 to obtain an error voltage proportional to $|Ar_1+j\,3|-|Br_2+j\,r_4|$. This error voltage is amplified by a d-c amplifier 852 and is applied to the grid of cathode follower 814; it will be understood that the error voltage thus controls a d-c servo loop that automatically adjusts $r_4$ to the proper value—i.e., $r_4=\sqrt{Ar_1-Br_2+Cr_3}$.

It will be apparent that the embodiments shown are only exemplary and that various modifications can be made in construction and arrangement within the scope of the invention as defined in the appended claims.

I claim:

1. In an ordnance projectile having a side-spray warhead with a static fragmentation velocity $V_{FS}$, an ordnance fuze comprising: radar means for making measurements of range and sight angle of a target; sources of fixed voltages proportional to predetermined target coordinates $Z_1$, $Z_2$, and $Z_3$, in a coordinate system that rides with the fuze, the fuze trajectory being in the plus-Z direction; means for obtaining three voltages proportional to $r_1$, $r_2$, and $r_3$, where $r_1$, $r_2$, and $r_3$ are the fuze-to-target distances when the target Z-coordinates are $Z_1$, $Z_2$, and $Z_3$ respectively; means for obtaining a voltage proportional to $V_Z$, where $V_Z$ is the rate of change of the Z-coordinate of the target with time; a source of fixed voltage proportional to said static fragmentation velocity $V_{FS}$; electronic computer means for solving the equation $$\Delta T=Z_3/V_Z-r_4/V_{FS},$$

where $$r_4=\sqrt{A^2r_1^2-B^2r_2^2+C^2r_3^2},$$

$$A^2=\frac{Z_2Z_3}{(Z_1-Z_3)(Z_1-Z_2)},$$

$$B^2=\frac{Z_1Z_3}{(Z_1-Z_2)(Z_2-Z_3)},$$

and $$C^2=\frac{Z_1Z_2}{(Z_1-Z_3)(Z_2-Z_3)},$$

$r_4$ being the fuze-to-target distance corresponding to Z=zero, said computer means including a subcomputer for solving the equation $r_4=\sqrt{A^2r_1^2-B^2r_2^2+C^2r_3^2}$; and means for causing detonation of said warhead at time $t_3+\Delta T$, where $t_3$ is the time at which the Z-coordinate and distance of the target are $Z_3$ and $r_3$ respectively.

2. The invention according to claim 1, said subcomputer comprising: first, second, and third terminals adapted to receive input voltages $Ar_1$, $Br_2$, and $Cr_3$ respectively; a fourth terminal from which output voltage $r_4$ is taken; first and second addition means; first and second square-wave gating means connected between said first addition means and said first and second terminals respectively, said first and second gating means being identical in fundamental frequency and in waveform but having their fundamental frequencies in phase quadrature; third and fourth square-wave gating means connected between said second addition means and said third and fourth terminals respectively, said third and fourth gating means being identical in fundamental frequency and in waveform but having their fundamental frequencies in phase quadrature; first and second rectifier means for rectifying the outputs of said first and second addition means respectively; means for obtaining an error signal proportional to the difference in the outputs of said first and second rectifier means; and means for connecting said error signal to said fourth terminal, so that the d-c potential of said fourth terminal is caused automatically to approach the value $r_4$ that will satisfy the equation $$|r_4+j\,2|=|Ar_1+j\,3|.$$

3. The invention according to claim 2, there being common to said first, second, third, and fourth gating means a generator having two square-wave output signals of frequency f in phase quadrature, said generator comprising: a first source of periodic pulses of frequency 4f; a first flip-flop circuit driven by said first source having first and second plates, the output signals at said plates being square waves in push-pull having a fundamental frequency 2f; and second and third flip-flop circuits driven by the signals from said first and second plates respectively, the outputs of said second and third flip-flops having a fundamental frequency f and being in phase quadrature.

4. In an ordnance fuze as described, an electronic computer for solving the equation $$r_4=\sqrt{A^2r_1^2-B^2r_2^2+C^2r_3^2}$$

by operating on fixed d-c voltages proportional to $Ar_1$, $Br_2$, and $Cr_3$, said computer comprising: first, second, and third terminals adapted to receive input voltages $Ar_1$, $Br_2$, and $Cr_3$ respectively; a fourth terminal from which output voltage $r_4$ is taken; first and second addition means; first and second square-wave gating means connected between said first addition means and said first and second terminals respectively, said first and second gating means being identical in fundamental frequency and in waveform but having their fundamental frequencies in phase quadrature; third and fourth square-wave gating means connected between said second addition means and said third and fourth terminals respectively, said third and fourth gating means being identical in fundamental frequency and in waveform but having their fundamental frequencies in phase quadrature; first and second rectifier means for rectifying the outputs of said first and second addition means respectively; means for obtaining an error signal proportional to the difference in the outputs of said first and second rectifier means; and means for connecting said error signal to said fourth terminal, so that the d-c potential of said fourth terminal is caused automatically to approach the value $r_4$ that will satisfy the equation $$|r_4+j\,Br_2|=|Ar_1+j\,Cr_3|.$$

5. The invention according to claim 4, there being common to said first, second, third, and fourth gating means a generator having two square-wave output signals of frequency f in phase quadrature, said generator comprising: a first source of periodic pulses of frequency 4f; a first flip-flop circuit driven by said first source having first and second plates, the output signals at said plates being square waves in push-pull having a fundamental frequency 2f; and second and third flip-flop circuits driven by the signals from said first and second plates respectively, the outputs of said second and third flip-flops having a fundamental frequency f and being in phase quadrature.

* * * * *